US007641070B2

(12) United States Patent
Ho

(10) Patent No.: US 7,641,070 B2
(45) Date of Patent: Jan. 5, 2010

(54) LOW COST SPILL-RESISTANT CUP FOR LIQUIDS

(75) Inventor: I-Chung Ho, Rancho Palos Verdes, CA (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

(21) Appl. No.: 11/856,017

(22) Filed: Sep. 15, 2007

(65) Prior Publication Data

US 2008/0000920 A1 Jan. 3, 2008

Related U.S. Application Data

(63) Continuation-in-part of application No. 11/307,912, filed on Feb. 28, 2006.

(51) Int. Cl.
*A47G 19/22* (2006.01)

(52) U.S. Cl. ..... 220/711; 220/254.3; 220/719; 229/404; 229/906.1

(58) Field of Classification Search ..... 222/457, 222/478–479, 547, 564, 566; 220/254.3, 220/716–717, 719, 711; 229/404, 906.1
See application file for complete search history.

(56) References Cited

U.S. PATENT DOCUMENTS 129,451 A 7/1872 Baldwin
236,997 A 1/1881 Dodge
570,759 A 11/1896 Law
836,466 A 11/1906 Sears (Continued)

FOREIGN PATENT DOCUMENTS

CA 1156464 11/1983

(Continued)

OTHER PUBLICATIONS

Information Disclosure Statement (IDS) Letter Regarding Common Patent Application(s), submitted by Applicant on Mar. 3, 2009.

(Continued)

*Primary Examiner*—Kevin P Shaver
*Assistant Examiner*—Andrew P Bainbridge
(74) *Attorney, Agent, or Firm*—Chad D. Tillman; James D. Wright; Tillman Wright, PLLC

(57) ABSTRACT

The improved low cost Spill-Resistant Cup for storing and dispensing liquids resists spilling when shaken or vibrated suddenly. The improved cup has a scoop-like-baffle and a push tab that separates the body of the cup with the mouth-piece of the cover. An opening is created when the push tab is pressed and the push tab springs back to close the opening when the pressure is released. When the improved cup is tilted and the tab pushed down for pouring, such that the liquid level inside the storage chamber of the cup chamber is higher than the liquid level at the opening, no liquid pours out of the cup. The liquid starts to flow out of the mouth opening after the cup is tilted beyond a start-to-pour angle. The start-to-pour angle is reached when the cup is tilted permitting the outside air to pass through the opening of the scoop-like-baffle and into the storage chamber.

17 Claims, 3 Drawing Sheets

U.S. PATENT DOCUMENTS 845,175 A 2/1907 Hutchins
1,151,997 A 8/1915 Beck et al.
2,249,197 A 7/1941 Brundin
2,370,820 A 3/1945 Stott
2,387,699 A 10/1945 Bates
2,723,341 A 11/1955 Greenspan
3,067,543 A 12/1962 Bracey
3,090,532 A 5/1963 Robson
3,171,580 A * 3/1965 Davis et al. ..... 229/404
3,235,143 A 2/1966 Goodrich
3,271,900 A 9/1966 Mori
3,410,459 A 11/1968 Conley
3,753,315 A 8/1973 Adam
3,860,162 A 1/1975 Schutz
3,881,506 A 5/1975 Hazen
3,902,652 A 9/1975 Malcolm
3,927,794 A 12/1975 Erdman
4,073,397 A 2/1978 Snodgrass
4,148,155 A 4/1979 Allen
4,185,414 A 1/1980 Miller
4,245,752 A * 1/1981 Prueher ..... 220/266
4,341,040 A 7/1982 Smith
4,346,532 A 8/1982 Peterson
4,349,864 A 9/1982 Smith
4,361,249 A 11/1982 Tuneski et al.
D270,518 S 9/1983 Duering
4,412,633 A 11/1983 Guerrazzi et al.
4,437,587 A 3/1984 Duering
4,441,623 A * 4/1984 Antoniak ..... 220/711
4,491,245 A 1/1985 Jamison
D288,334 S 2/1987 Simons
D288,889 S 3/1987 Mantani
4,805,342 A 2/1989 Jenkins et al.
4,829,708 A 5/1989 Gonzalez
4,829,709 A 5/1989 Centafanti
4,856,685 A 8/1989 Gaffney
4,864,771 A 9/1989 Fah
4,896,457 A 1/1990 Pitcher
4,925,051 A * 5/1990 Herbst ..... 220/713
4,935,283 A 6/1990 Jamison
4,999,947 A 3/1991 Whitaker
5,044,120 A 9/1991 Couch
5,067,501 A 11/1991 Auger
5,085,355 A 2/1992 Yoshimura et al.
5,123,575 A 6/1992 Li
5,180,552 A 1/1993 Saceman
5,201,860 A 4/1993 Richardson
5,217,696 A 6/1993 Wolverton et al.
5,241,784 A 9/1993 Henry
5,269,094 A 12/1993 Wolverton et al.
5,277,877 A 1/1994 Jeffrey et al.
D348,802 S 7/1994 Miller
5,329,729 A 7/1994 Liang
5,340,000 A 8/1994 Ring
5,351,438 A 10/1994 Wolverton et al.
5,356,053 A 10/1994 Di Fatta
5,430,972 A 7/1995 Wianecki
5,433,923 A 7/1995 Wolverton et al.
5,454,187 A 10/1995 Wasserman
5,467,903 A 11/1995 Sorensen et al.
5,509,568 A * 4/1996 Warden et al. ..... 220/711
5,509,579 A 4/1996 Robbins
5,547,109 A * 8/1996 Robbins, III ..... 222/158
5,579,962 A 12/1996 Chen
5,638,638 A 6/1997 Moskowitz
5,669,329 A 9/1997 Krause
5,749,170 A 5/1998 Furuta
5,819,994 A 10/1998 Leipold
5,897,035 A 4/1999 Schlomer
5,979,689 A 11/1999 Lansky
6,220,476 B1 4/2001 Waller
6,305,571 B1 10/2001 Chu
6,412,664 B1 7/2002 Wolff et al.
6,419,105 B1 * 7/2002 Bruce et al. ..... 220/266
6,431,390 B1 * 8/2002 Waller ..... 220/713
6,460,741 B1 10/2002 Ho
6,533,139 B2 3/2003 Lukacevic
6,612,456 B1 * 9/2003 Hundley et al. ..... 220/254.3
6,702,145 B2 3/2004 Malcolm
6,758,375 B2 7/2004 Ho
7,063,224 B2 * 6/2006 Clarke et al. ..... 220/254.3
2007/0199945 A1 8/2007 Ho
2007/0199961 A1 8/2007 Ho

FOREIGN PATENT DOCUMENTS

CA 2411289 7/2003
CA 2315028 10/2007
CA 2635219 7/2008
DE 864469 1/1953
DE 3418266 12/1985
EP 195542 9/1986
FR 661013 7/1929
FR 1473290 3/1967
FR 2305123 10/1976
GB 2218609 11/1989
GB 2250171 6/1992
JP 2-092318 3/1990
WO 9424011 10/1994
WO 2009/036426 A2 3/2009

OTHER PUBLICATIONS

"International Search Report" and "Written Opinion of the International Search Authority" (Korean Intellectual Property Office) in Edison Nation, LLC, International Patent Application Serial No. PCT/2008/076406, dated Mar. 11, 2009, 7 pages.

* cited by examiner

LOW COST SPILL-RESISTANT CUP FOR LIQUIDS

CROSS REFERENCE TO RELATED APPLICATIONS

The present application is a continuation-in-part of U.S. patent application Ser. No. 11/307,912 filed Feb. 28, 2006, and is related to U.S. patent application Ser. No. 11/428,691 filed Jul. 5, 2006, which is also a continuation-in-part of application Ser. No. 11/307,912 filed Feb. 28, 2006. The entirety of each of these disclosures is incorporated herein by reference for all purposes.

FIELD OF THE INVENTION

The field of the invention is cups and other containers for dispensing a liquid and more particularly, is cups for dispensing a liquid with a smoother pour and with reduced spilling especially when shaken or vibrated suddenly.

BACKGROUND OF THE INVENTION

Man has used containers for storing and dispensing liquids for millennia. However, containers still have their problems. For example, full cups of soda or hot coffee sold in fast food restaurants being consumed in moving cars have caused many spilling accidents. Although these cups may be equipped with sealing lids with small mouth openings, spilling mishaps are still very common. Serious burns may result from a very hot coffee spill due to certain unavoidable mishap in a moving car. Therefore, there is a need for an improved low cost disposable cup and container, which ideally does not spill while drinking and, realistically is spill-resistant.

On the market, most low cost drinking cups for take out from a restaurant have attachable cover for customer to prevent spill. These covers are usually flat or have some forms of a dome shape with bent edges that fits snugly to the rim of the cup. A small opening is provided on the cover so that the user can drink from the cup with the cover remains attached. When the cup is shaken or vibrated suddenly due to unexpected breaking in a moving car or any other reason, spilling liquid splashed from the opening is common and often unavoidable. A simple low cost yet effective design to replace the current cup design and prevent the spill is needed. A U.S. Pat. No. 6,612,456 proposed a lid for the cup having a hinged portion of a re-closable opening for drinking. This design works well as long as the opening of the hinged re-closable portion is in the closed position. However, when the user opens the hinged portion for drinking, few if any will re-close the opened portion and thus lost its protective feature for spill prevention and making it no more different from most of the cups on the market.

This inventor has developed a number of spill-resistant containers; U.S. Pat. Nos. 6,098,850; 6,374,541; 6,460,741; and 6,758,375 using a hydrostatic principle in achieving the spill-resistant feature. The present invention simplifies the design and allows a scoop-like-baffle with a self re-closeable opening feature and a fitted mouthpiece to be made as an integral part of the cover and achieving the desired low cost spill-resistant cup.

SUMMARY OF THE INVENTION

The improved cup for storing and dispensing liquids has an integral downward scoop-like-baffle with a self re-closable opening on the cover of the cup. The improved cup resists spilling and pours the liquid more smoothly.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. Moreover, in the figures, like reference numerals designate corresponding parts throughout the different views. However, like parts do not always have like reference numerals. Moreover, all illustrations are intended to convey concepts, where relative sizes, shapes and other detailed attributes may be illustrated schematically rather than literally or precisely.

DETAILED DESCRIPTION OF THE INVENTION

Figure 1:
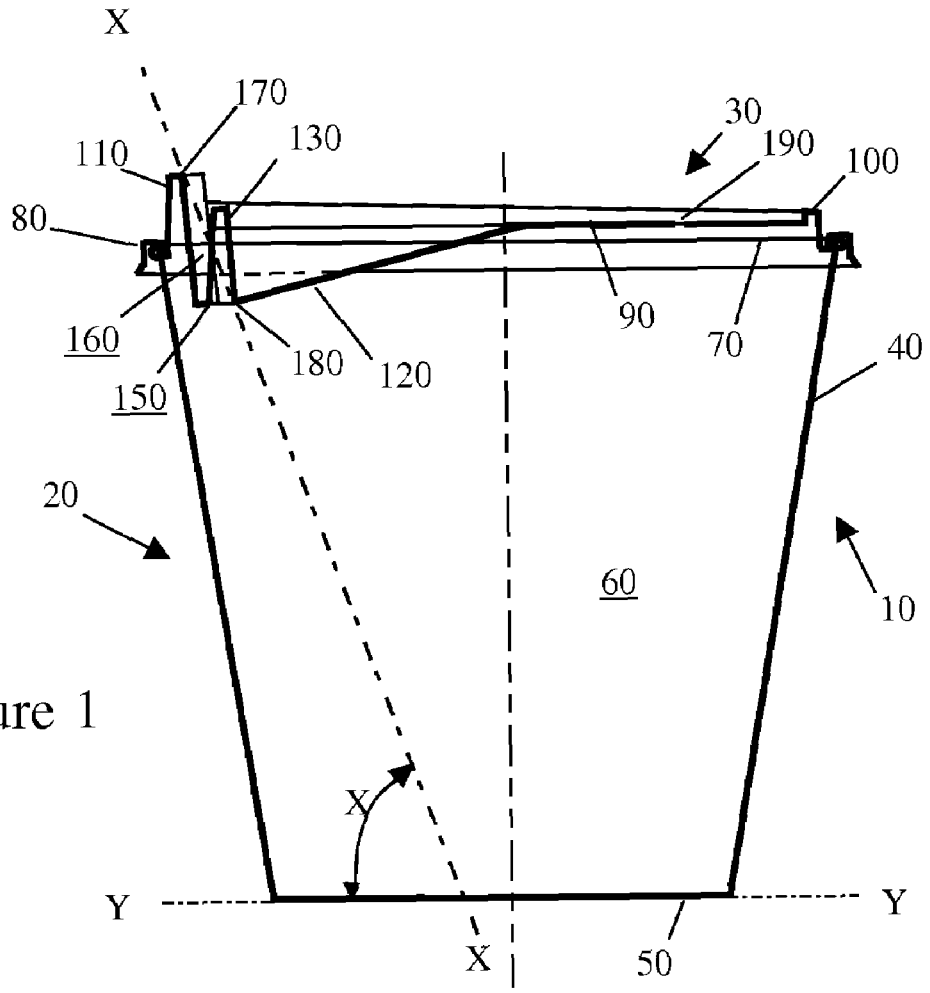
FIG. 1 is a schematic representation of a cross-sectional side view of an example embodiment of the spill-resistant cup including an ordinary body of the cup, and a removable cover having a scoop-like-baffle.

FIG. 1 is a schematic representation of the cross-sectional side view of a preferred example embodiment of a spill-resistant cup 10. The heavy dark line shown in this drawing and all following drawings represent the cut walls of the cup. FIG. 1 illustrates a substantially circular shape of the spill-resistant cup 10 (the circular shape of the body of the cup as illustrated here serves only as an example because it can be of many other shapes and forms). This cup consists of a body of the cup 20 and a removable cover 30. The body of the cup 20 has a cone shaped sidewall 40 and a bottom 50 to form a storage chamber 60 for holding the drinking fluid. The upper edge of the sidewall 40 has a rim 70. The removable cover 30 has a lip 80 around the outer circle that can be sealingly snap onto the rim 70 of the body of the cup 20. The removable cover 30 may be substantially flat or have an optional large or small dome 90 with or without a dome-rim 100 around the edge of the small dome 90. One portion of the dome-rim 100 is raised higher to form a mouthpiece 110 to fit with the mouth while drinking. In line with the mouthpiece 110 on the small dome 90 there is an integral downward scoop-like-baffle 120 with a push-down-tab 130 to act like a barrier to prevent spilling. One of the methods of making the removable cover 30 is by thermal vacuum forming from a thin gauge plastic sheet. During the process of forming this removable cover 30, a cut line 140 (better shown in FIG. 4 below) on the scoop-like-baffle 120 partially around the base of the push-down-tab 130. This cut-line 140 on the scoop-like-baffle 120 around the base of the push-down-tab 130 allows the push-down-tab 130 to be bent downward from the scoop-like-baffle 120 when the push-down-tab 130 is pushed downward. The plastic removable cover 30 has certain rigidity, when the push-down-tab 130 is pushed downward, a small opening 150 in the scoop-like-baffle 120 is created. This opening allows liquid to flow out for drinking. When the push down pressure is released the push-down-tab 130 springs back up by itself to its un-open position and reduces the small opening 150 to a minimum gap opening and further minimizes the chance of a spill. After the storage chamber 60 of the body of the cup 20 is filled with drinking fluid, the lip 80 of the removable cover 30 is sealingly snapped onto the rim 70 of the body of the cup 20 to complete the spill-resistant cup 10. The small opening 150 created by the cut-line 140 on the scoop-like-baffle 120 with the push-down-tab 130 and the mouthpiece 110 forms a flow passageway 160 for the fluid to flow out. When drinking, the upper lip of the mouth is pressed against the push-down-tab 130 to press it downward and open up the small opening 150. Fluid in the storage chamber 60 flows out through the small opening 150 on to the mouthpiece 110 into the mouth. When not drinking and the spill-resistant cup 10 is tilted in a counter-clockwise direction, the mouthpiece 110 has a lowest point 170 and the small opening 150 (reduced to a minimum gap for not been pressed downward) has an apex point 180 at the scoop-like-baffle 120. Connecting the lowest point 170 and the apex 180 with a straight line forms a start-to-pour line X-X. The angle between the start-to-pour line X-X and the horizontal line Y-Y is the start-to-pour angle X. The usage of this start-to-pour line X-X will be described later.

Figure 2:
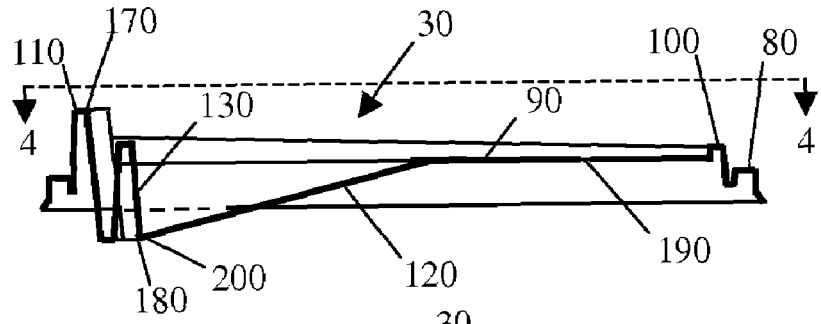
FIG. 2 is the same view of the removable cover in FIG. 1 without the body of the cup.

FIG. 2 is the removable cover 30 in the same view of FIG. 1 without the body of the cup 20. The small dome 90 shown in this sample has a raised dome-rim 100 of uneven height around the edge of the small dome 90 with higher portion of the mouthpiece 110 at near the scoop-like-baffle 120. The small dome 90 of the removable cover 30 can be of any suitable size and shape with or without a rim to meet user's preferences. There is also a small pinhole 190 on the small dome 90 as a vent to help the out flow of liquid while drinking.

Figure 3:
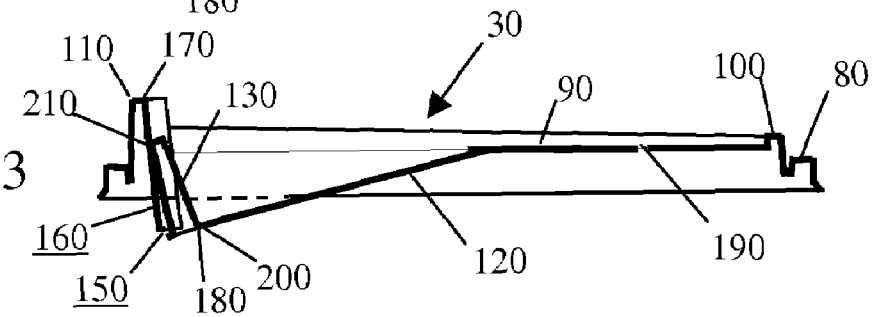
FIG. 3 is the same view of the removable cover in FIG. 2 with the push-down-tab being depressed for drinking.

FIG. 3 is the same view of the removable cover shown in FIG. 2 with the push-down-tab 130 being depressed when drinking. When the push-down-tab 130 being pushed downward it will bend along the bend-line 200 (better shown in FIG. 4) and creates a small opening 150 on the scoop-like-baffle 120. The upper tip of the push-down-tab 130 rests against the sidewall of the mouthpiece 110 at point 210 to stop the push-down-tab 130 from bending any further.

Figure 4:
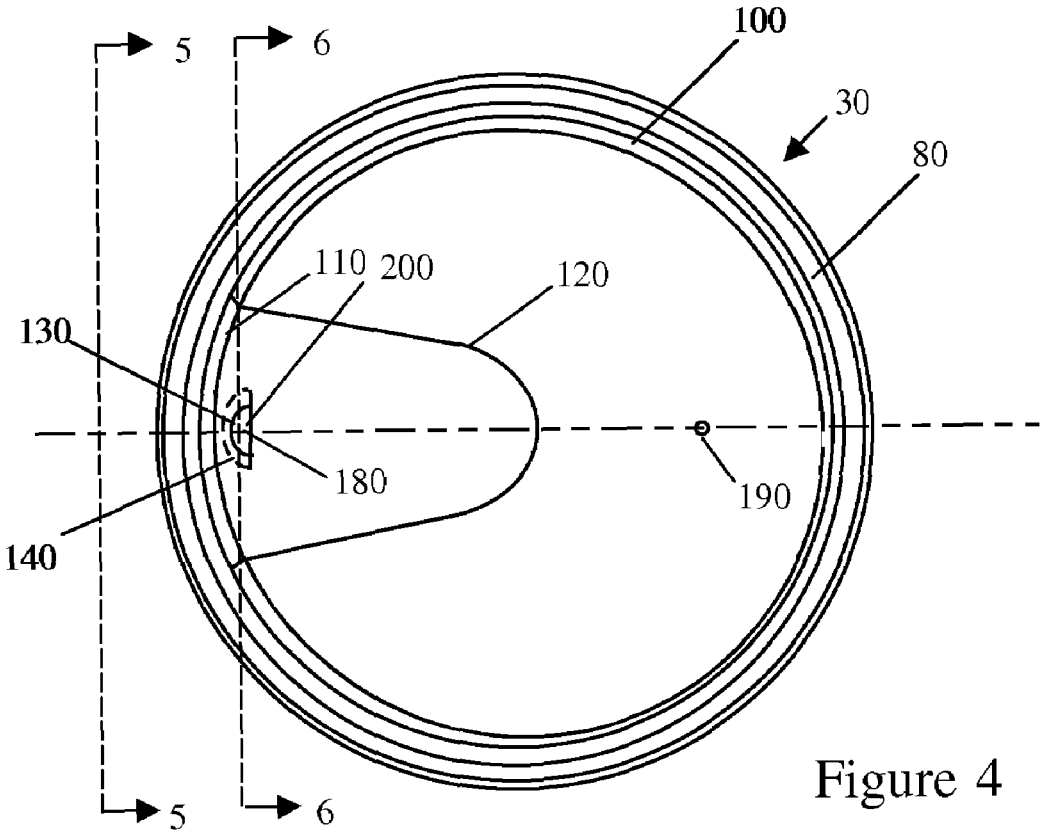
FIG. 4 is the top view of the removable cover of the spill-resistant cup taken along line 4-4 of FIG. 2.

FIG. 4 is the top view of the removable cover 30 of the spill-resistant cup taken along line 4-4 of FIG. 2. The push-down-tab 130 as shown has a half cylindrical shape. It can be any other suitable shape and size. The cut-line 140 is a half circle with slightly larger radius then the radius of the push-down-tab 130. It can also be in other form to fit the shape and size of any push-down-tab 130. The curved scoop-like-baffle 120 with the apex 180 are better shown in this view, which coincide with the bend line 200 in this example. The shape of this scoop-like-baffle 120 is shown as an example; other suitable form and shape may be used. When pushing down the push-down-tab 130, the portion of the scoop-like-baffle 120 including the push-down-tab 130 will bend downward along the bend line 200 and create a small opening 150 (does not show in this view) in the scoop-like-baffle 120. The scoop-like-baffle 120 formed from a region of the dome 90 of the removable cover 30 by bending it downward toward the storage chamber 60 of the body of the cup 20.

Figure 5:
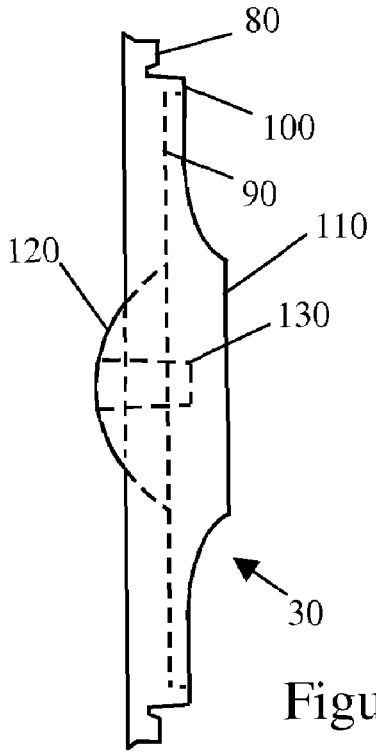
FIG. 5 is a schematic representation of a side view of the removable cover of the spill-resistant cup taken along line 5-5 of FIG. 4.

FIG. 5 is a schematic representation of a side view of the removable cover 30 of the spill-resistant cup 10 taken along line 5-5 of FIG. 4. The mouthpiece 110 is a local raised portion of the dome-rim 100.

Figure 6:
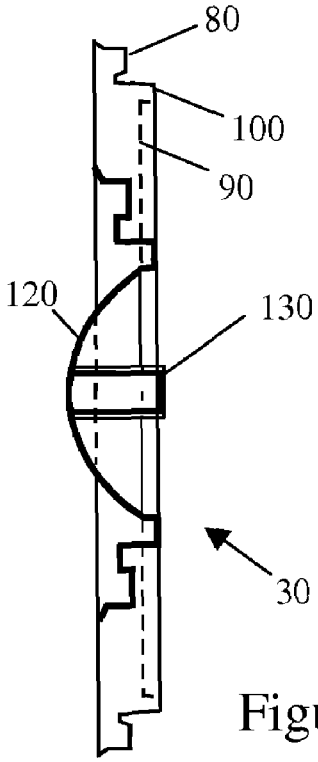
FIG. 6 is a schematic representation of a cross-sectional side view of the removable cover of the spill-resistant cup taken along line 6-6 of FIG. 4.

FIG. 6 is a schematic representation of a cross-sectional side view of the removable cover 30 of the spill-resistant cup 10 taken along line 6-6 of FIG. 4.

Figure 7:
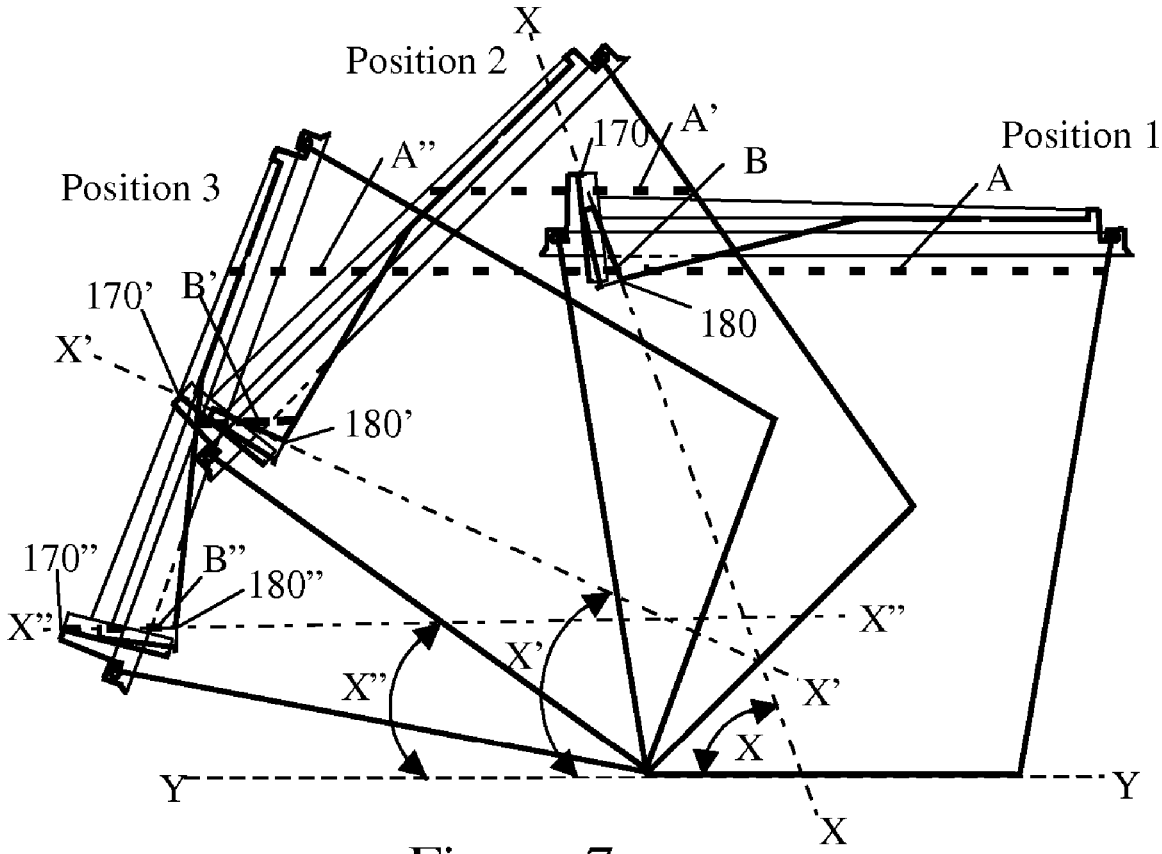
FIG. 7 is a schematic representation showing how the spill-resistant cup operates.

FIG. 7 is a schematic representation of how the spill-resistant cup 10 operates to prevent spilling when not drinking but being tilted accidentally. The spill-resistant feature of the scoop-like-baffle 90 can prevent accidental spill for allowing the spill-resistant cup 10 to be tilted up to the start to pour angle. To explain its operation, first assume that the pinhole 190 does not exist. The fully filled cup of the spill-resistant cup 10 of FIG. 1 is being rotated in counter-clockwise direction in three different angles from the vertical position 1 to the start to pour position 3 through an intermediate position 2. At position 1 the filled spill-resistant cup 10 has a liquid level line A in the liquid storage chamber 60 and a liquid level line B at the scoop-like-baffle 120. When the spill-resistant cup 10 is tilted from position 1 to position 2, the liquid level line A in the liquid storage chamber 60 is moved to liquid level line A' and the liquid level line B at the scoop-like-baffle 120 is moved to liquid level line B'. At this position the start-to-pour line X-X changed to line X'-X' and the angle X between the start-to-pour line X-X and the horizontal line Y-Y reduced to angle X'. The lowest point 170 is moved to 170' and the apex 180 is moved to 180'. The liquid level line B' at the scoop-like-baffle 120 is lower than the lowest point 170' at the mouthpiece 110 and higher than the apex 180' at the scoop-like-baffle 120. Because at this tilting angle, the liquid level line B' stops any outside air from passing through the small opening 150 (the gap opening created around the cut line 140) and entering into the liquid storage chamber 60. Liquid inside the liquid storage chamber 60 cannot flow out of the small opening 150. This allows the liquid level A' in the liquid storage chamber 60 to be higher than the small opening 150 without allowing the out flow of liquid and thus preventing the spilling of liquid. When the spill-resistant cup 10 is tilted further from position 2 to position 3 where the start-to-pour line X"-X" becomes horizontal. At this tilting angle, the liquid level line A in the liquid storage chamber 60 tilted to liquid level line A" and the liquid level line B at the scoop-like-baffle 120 tilted to liquid level line B". The start-to-pour angle X is reduced from X to X" or zero degrees. The lowest point 170 is moved to 170" and the apex 180 is moved to 180", which is raised to the same height of the lowest point 170". The start-to-pour line X"-X" is now parallel to the horizontal line Y-Y and is in line with the liquid level line B" at the scoop-like-baffle 120. At this tilting angle, the liquid level line B" is in line with the lowest point 170" at the mouthpiece 110 and the apex 180" at the scoop-like-baffle 120. With any slight increase in tilting angle, outside air will be able to enter the small opening 150 into the liquid storage chamber 60 through the apex point 180". Once air starts to enter the liquid storage chamber 60, liquid will start to pour out of the small opening 150. This illustration shows that this spill-resistant cup 10 is spill resistant to sudden shaking or vibration when the spill-resistant cup 10 is upright or at position 1. Because liquid will not flow out until the spill-resistant cup 10 is tilted to the start to pour angle X or position 3. With the presence of a pinhole 190, the start to pour angle will decrease. The amount of decrease is inversely dependant to how fast or how slow the spill-resistant cup 10 is being tilted. The faster it is tilted or sudden shaking the less the effect from this pinhole's existence. Therefore, the effect to the spill resistant feature by the presence of this pinhole is small. Pinhole 190 is needed to allow air to enter the storage chamber 60 for smooth drinking because the mouth often cover the entire small opening 150 while drinking.

What is claimed is:

1. A cup for dispensing liquid with less chance of spilling, the cup comprising:

a cover;

a bottom opposite the cover;

a cup body disposed between the cover and the bottom;

the cup body including a liquid storage chamber;

a baffle bended downward on the cover;

a mouthpiece around a portion of the cover; and a push tab at least partially attached to the baffle along a bend line so as to allow the push tab to be pushed and to bend downward to create an opening allowing for the flow of liquid between the push tab and the mouthpiece.

2. The cup of claim 1 wherein the mouthpiece extends upwardly from the removable cover when the removable cover is in an upright position, wherein the mouthpiece has a lowest point, wherein the opening at the push tab of the baffle has an apex point, wherein both points are located at different elevations, wherein connecting the lowest point and the apex point forms a start-to-pour line, and wherein the cup is adapted to allow a liquid in the cup to flow out of the cup when the cup is tilted beyond a start-to-pour angle.

3. The cup of claim 1 wherein the baffle is a scoop-like baffle.

4. The cup of claim 3 wherein the baffle has a curved surface.

5. The cup of claim 1 wherein the cover has a pinhole.

6. A cup for dispensing liquid with less chance of spilling, the cup comprising:

a removable cover;

a mouthpiece with a lowest point disposed on the removable cover, wherein the mouthpiece extends upwardly from the removable cover when the removable cover is in an upright position;

a bottom opposite the removable cover;

a sidewall disposed between the removable cover and the bottom forms a liquid storage chamber;

a scoop-like-baffle bended downward from the removable cover;

a push tab at least partially attached at the scoop-like-baffle with a bend line and a cut for bending the push tab that forms a liquid flow opening area between the push tab and the mouthpiece and having an apex point;

a start-to-pour line may be drawn from the lowest point to the apex point;

the start-to-pour line forms a start-to-pour angle with a horizontal line; and the mouthpiece disposed on the removable cover and adapted for the liquid in the cup to flow out of the cup when the cup is tilted beyond the start-to-pour angle.

7. The cup of claim 6 wherein the liquid flow opening area is a channel for liquid flow between the mouthpiece and the liquid storage chamber.

8. The cup of claim 6 wherein the scoop like-baffle has a curved surface.

9. The cup of claim 6 wherein the removable cover has a pinhole.

10. A cup for dispensing liquid with less chance of spilling, the cup comprising:

a removable cover;

a bottom opposite the removable cover;

a cup body disposed between the removable cover and the bottom;

a mouthpiece in the removable cover;

the cup body including a liquid storage chamber;

a baffle with a push tab attached thereto and a cut partially around the push tab wherein an opening is created between the push tab and the mouthpiece when the push tab is bent and adapted for the liquid in the cup to flow through the opening out toward the mouthpiece when the cup is tilted beyond a start-to-pour angle.

11. The cup of claim 10, wherein the baffle is a scoop-like baffle.

12. The baffle of claim 10, wherein the scoop-like-baffle has a curved surface.

13. The cup of claim 10, wherein the removable cover has a pinhole.

14. The cup of claim 2, wherein the apex point extends entirely within an interior portion of the cup body below a lip of the cover.

15. The cup of claim 1, wherein the push tab returns to an un-opened position when push down pressure is removed.

16. The cup of claim 10, wherein the opening extends entirely within an interior portion of the cup body below a lip of the removable cover.

17. The cup of claim 10, wherein the push tab returns to an un-opened position when push down pressure is removed.

* * * * *